US010647546B2

(12) United States Patent
Shepherd et al.

(10) Patent No.: US 10,647,546 B2
(45) Date of Patent: May 12, 2020

(54) HYDRAULICALLY ACTIVATED SHUTOFF VALVE FOR A HYDRAULIC ELEVATOR SYSTEM

(71) Applicant: OTIS ELEVATOR COMPANY, Farmington, CT (US)

(72) Inventors: Kevin Shepherd, Florence, SC (US); James O'Neal Creel, Jr., Hemingway, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 407 days.

(21) Appl. No.: 15/381,484

(22) Filed: Dec. 16, 2016

(65) Prior Publication Data

US 2018/0170715 A1 Jun. 21, 2018

(51) Int. Cl.
*B66B 9/04* (2006.01)
*B66B 5/02* (2006.01)
(Continued)

(52) U.S. Cl.
CPC ..... *B66B 5/028* (2013.01); *B66B 5/0087* (2013.01); *F15B 13/02* (2013.01)

(58) Field of Classification Search
CPC ..... B66B 5/028; B66B 5/0087; F15B 13/02
See application file for complete search history.

(56) References Cited

U.S. PATENT DOCUMENTS 3,207,177 A * 9/1965 Nevulis ..... B66C 13/18 137/522
3,282,552 A * 11/1966 Sommese, Sr. ..... B66B 1/24 251/26

(Continued)

FOREIGN PATENT DOCUMENTS

CN 1181740 A 5/1998
CN 204096842 U 1/2015

(Continued)

OTHER PUBLICATIONS

Extended European Search Report for Application No. EP 17 20 6835 dated Sep. 25, 2018.

*Primary Examiner* — Michael A Riegelman
(74) *Attorney, Agent, or Firm* — Carlson, Gaskey & Olds

(57) ABSTRACT

An illustrative example hydraulic elevator system includes an elevator car, a hydraulic plunger associated with the elevator car, a fluid reservoir and a conduit coupling the fluid reservoir and the hydraulic plunger. A pump causes fluid movement through the conduit between the fluid reservoir and the hydraulic plunger to cause selective movement of the elevator car. A shutoff valve is associated with the conduit, the shutoff valve being between the pump and the hydraulic plunger. The shutoff valve has a closed position in which the shutoff valve prevents fluid movement between the hydraulic plunger and at least one of the reservoir and the pump to prevent movement of the elevator car. The shutoff valve has an open position in which the shutoff valve permits fluid movement between the pump and the hydraulic plunger to permit movement of the elevator car. A valve actuator operates based on pressure in at least the hydraulic plunger. The valve actuator selectively causes the shutoff valve to be in the open position or the closed position.

17 Claims, 2 Drawing Sheets

(51) Int. Cl.
*B66B 5/00* (2006.01)
*F15B 13/02* (2006.01)

(56) References Cited

U.S. PATENT DOCUMENTS 3,408,035 A * 10/1968 Decker ..... F15B 7/005 251/129.03
3,819,147 A * 6/1974 Morrison ..... F16K 31/14 251/14
4,162,718 A * 7/1979 Lamprey ..... B66B 5/028 187/277
4,687,179 A * 8/1987 Smith ..... E21B 34/02 251/56
4,830,146 A * 5/1989 Nakamura ..... B66B 9/04 187/253
5,636,652 A * 6/1997 Toschi ..... B66B 1/24 137/1
6,347,515 B1 * 2/2002 Kadoche ..... B66B 1/24 60/372
6,378,660 B1 * 4/2002 Adifon ..... B66B 9/04 187/272
7,134,528 B2 * 11/2006 Birbaumer ..... B66B 1/24 187/285
7,946,391 B2 * 5/2011 Von Holzen ..... B66B 11/0423 187/272
8,640,829 B2 * 2/2014 Block, Jr. ..... B66B 9/04 187/272
9,163,619 B2 * 10/2015 Lymberopoulos ..... F04B 23/00
9,457,986 B2 * 10/2016 Bisig ..... B66B 1/24
2013/0333982 A1 * 12/2013 Haapaniemi ..... B66B 5/0031 187/275
2014/0216854 A1 * 8/2014 Stofira ..... B66B 11/002 187/247
2016/0186929 A1 * 6/2016 Klaphake ..... F04B 17/03 184/6.4
2018/0170715 A1 * 6/2018 Shepherd ..... B66B 5/0087
2019/0116718 A1 * 4/2019 Ito ..... B66B 1/3407

FOREIGN PATENT DOCUMENTS

GB 1047353 2/1964
JP H06100271 A 4/1994
JP H1036040 A 2/1998
WO 2012/161674 A1 11/2012

* cited by examiner

HYDRAULICALLY ACTIVATED SHUTOFF VALVE FOR A HYDRAULIC ELEVATOR SYSTEM

BACKGROUND

There are various types of elevator systems. Some are traction-based and include roping connecting an elevator car to a counterweight. A machine causes a traction sheave to rotate to cause longitudinal movement of the roping for moving the elevator car up or down. Other elevator systems are hydraulic based and include a plunger or jack that extends or retracts based on hydraulic fluid supplied into or withdrawn from the plunger. As the plunger extends, the elevator car moves upward and as the plunger retracts, the elevator car moves downward.

Regardless of the type of elevator system, measures are taken to protect mechanics and technicians performing maintenance on the elevator system. In the case of hydraulic elevators, a safety or shutoff valve prevents the hydraulic fluid from leaving the plunger so that the elevator car cannot descend. Known shutoff valves are manually operated and typically include a handle that provides a visual confirmation of the position of the valve, such as open or closed.

Modern trends in elevator systems include eliminating machine rooms and making the elevator system integration into a building as seamless as possible. These changes are beneficial to building owners but present challenges to elevator system providers. For example, the shutoff valve for a hydraulic elevator system may be located in a machine room or a cabinet near the elevator hoistway. Eliminating such machine rooms and cabinets makes it challenging to incorporate a shutoff valve to provide the desired protection against elevator car movement during maintenance procedures when an individual may be located beneath the car.

While an electrically operated, remotely controllable valve could potentially be used in such systems, there are a few drawbacks to that approach. Otis Elevator Company, for example, prefers a visual indication of the position of a manual shutoff valve. Many electrically operated valves have internally moving parts and do not provide external, visual indications of valve position. Additionally, an electrically operated valve would introduce additional expense compared to a manually operated valve. Further, an electrically operated valve would require sufficient power and would not be useful in situations where power is lost or not available.

There is a need for a valve arrangement for selectively controlling whether an elevator car can move in a hydraulic elevator system even in installations where a manually actuated valve is not accessible.

SUMMARY

An illustrative example hydraulic elevator system includes an elevator car, a hydraulic plunger associated with the elevator car, a fluid reservoir and a conduit coupling the fluid reservoir and the hydraulic plunger. A pump causes fluid movement through the conduit between the fluid reservoir and the hydraulic plunger to cause selective movement of the elevator car. A shutoff valve is associated with the conduit, the shutoff valve being between the pump and the hydraulic plunger. The shutoff valve has a closed position in which the shutoff valve prevents fluid movement to and from the hydraulic plunger to prevent movement of the elevator car. The shutoff valve has an open position in which the shutoff valve permits fluid movement between the hydraulic plunger and at least one of the pump and the reservoir to permit movement of the elevator car. A valve actuator operates based on pressure in at least the hydraulic plunger. The valve actuator selectively causes the shutoff valve to be in the open position or the closed position.

In an example embodiment having one or more features of the hydraulic elevator system of the previous paragraph, the shutoff valve includes a handle that is moveable to place the shutoff valve into the open position or the closed position, the valve actuator comprises a ram coupled with the handle and the pressure causes movement of the ram to cause movement of the handle.

In an example embodiment having one or more features of the hydraulic elevator system of either of the previous paragraphs, the ram includes a piston and the valve actuator includes at least one control valve that controls fluid movement toward opposite sides of the piston. The control valve directs fluid toward a first side of the piston to cause movement of the ram for moving the shutoff valve into the closed position and the control valve directing fluid toward a second side of the piston to cause movement of the ram for moving the shutoff valve into the open position.

In an example embodiment having one or more features of the hydraulic elevator system of any of the previous paragraphs, a fluid outlet is associated with the at least one control valve, the fluid outlet being configured to direct fluid from one side of the piston to the reservoir and a check valve that permits fluid flow through the fluid outlet in one direction toward the reservoir and prevents fluid flow in an opposite direction through the fluid outlet.

In an example embodiment having one or more features of the hydraulic elevator system of any of the previous paragraphs, the control valve includes a solenoid that controls whether the control valve directs fluid toward one of the sides of the piston and the solenoid is powered by a battery.

In an example embodiment having one or more features of the hydraulic elevator system of any of the previous paragraphs, the control valve has a first position for directing fluid toward the first side of the piston, the control valve has a second position for directing fluid toward the second side of the piston and the control valve has a third position for maintaining a current amount of fluid on each side of the piston when the shutoff valve is in a desired one of the positions.

In an example embodiment having one or more features of the hydraulic elevator system of any of the previous paragraphs, at least one sensor provides an indication of a position of the ram as an indication of whether the shutoff valve is in the closed position.

In an example embodiment having one or more features of the hydraulic elevator system of any of the previous paragraphs, the shutoff valve comprises a manually operable ball valve.

In an example embodiment having one or more features of the hydraulic elevator system of any of the previous paragraphs, the shutoff valve has a handle for manually moving the shutoff valve between the open and closed positions. The handle is at least partially visible from outside the shutoff valve. The valve actuator is coupled to the handle for moving the handle and the valve actuator is coupled to the handle in a manner that allows for visual observation of a position of the handle indicative of a position of the shutoff valve.

In an example embodiment having one or more features of the hydraulic elevator system of any of the previous paragraphs, the pressure in the hydraulic plunger is caused by a weight of the elevator car.

An illustrative example assembly for controlling whether an elevator car can move in a hydraulic elevator system includes a shutoff valve configured to selectively allow or prevent a flow of elevator system hydraulic fluid through the shutoff valve to thereby selectively allow or prevent movement of an associated elevator car, respectively. A valve actuator includes a ram coupled to the shutoff valve in a manner that movement of the ram opens or closes the shutoff valve. At least one control valve is associated with the ram to selectively allow pressure of elevator system hydraulic fluid to cause movement of the ram for controlling whether the shutoff valve is open or closed.

In an example embodiment having one or more features of the assembly of the previous paragraph, the shutoff valve has an external handle adapted for manual manipulation to open or close the shutoff valve and the ram is coupled to the handle in a manner that the movement of the ram causes movement of the handle.

In an example embodiment having one or more features of the assembly of either of the previous paragraphs, the valve actuator includes a chamber and a piston situated for movement in the chamber, the piston is connected to the ram for movement with the ram, the control valve selectively controls pressure on opposite sides of the piston to control a position of the ram and whether the shutoff valve is open or closed.

In an example embodiment having one or more features of the assembly of any of the previous paragraphs, at least one detector provides an indication of a position of the piston within the chamber. The indication provides information regarding whether the shutoff valve is open or closed.

In an example embodiment having one or more features of the assembly of any of the previous paragraphs, a fluid outlet is associated with the at least one control valve, the fluid outlet being configured to direct fluid away from one side of the piston, and a check valve that permits fluid flow through the fluid outlet only away from the one side of the piston and prevents fluid flow in an opposite direction through the fluid outlet.

In an example embodiment having one or more features of the assembly of any of the previous paragraphs, the control valve has a first position for directing fluid toward a first side of the piston, the control valve has a second position for directing fluid toward a second side of the piston and the control valve has a third position for maintaining a current amount of fluid on each side of the piston when the shutoff valve is in a desired condition.

In an example embodiment having one or more features of the assembly of any of the previous paragraphs, the ram is coupled to the shutoff valve in a manner that allows visual observation of an external component of the shutoff valve which provides a visual indication of whether the shutoff valve is open or closed.

In an example embodiment having one or more features of the assembly of any of the previous paragraphs, the control valve includes a solenoid that is powered by a battery.

An illustrative example method of controlling whether an elevator car can descend in a hydraulic elevator system includes selectively using pressure of hydraulic fluid in the elevator system to move a shutoff valve into a closed position that does not allow the hydraulic fluid to flow through the shutoff valve to thereby prevent the elevator car from descending and selectively using pressure of the hydraulic fluid in the elevator system to move the shutoff valve into an open position that allows the hydraulic fluid to flow through the shutoff valve to thereby allow the elevator car to move.

In an example embodiment having one or more features of the method of the previous paragraph, a valve actuator ram is coupled to a handle of the shutoff valve and the ram includes a piston, the method comprising selectively allowing the hydraulic fluid to cause movement of the piston and the ram to move the handle in a manner that moves the shutoff valve between the open and closed positions.

Various features and advantages of at least one disclosed example embodiment will become apparent to those skilled in the art from the following detailed description. The drawings that accompany the detailed description can be briefly described as follows.

DETAILED DESCRIPTION

Embodiments of this invention include a hydraulically actuated valve assembly that uses pressure within a hydraulic elevator system to open or close a shutoff valve to provide control over whether an elevator car can move. With this invention it becomes possible for a technician to control valve operation without having to manually change the valve position, which is useful for elevator systems that do not include an access door into the location where the valve is situated or if the valve is otherwise not directly accessible.

Figure 1:
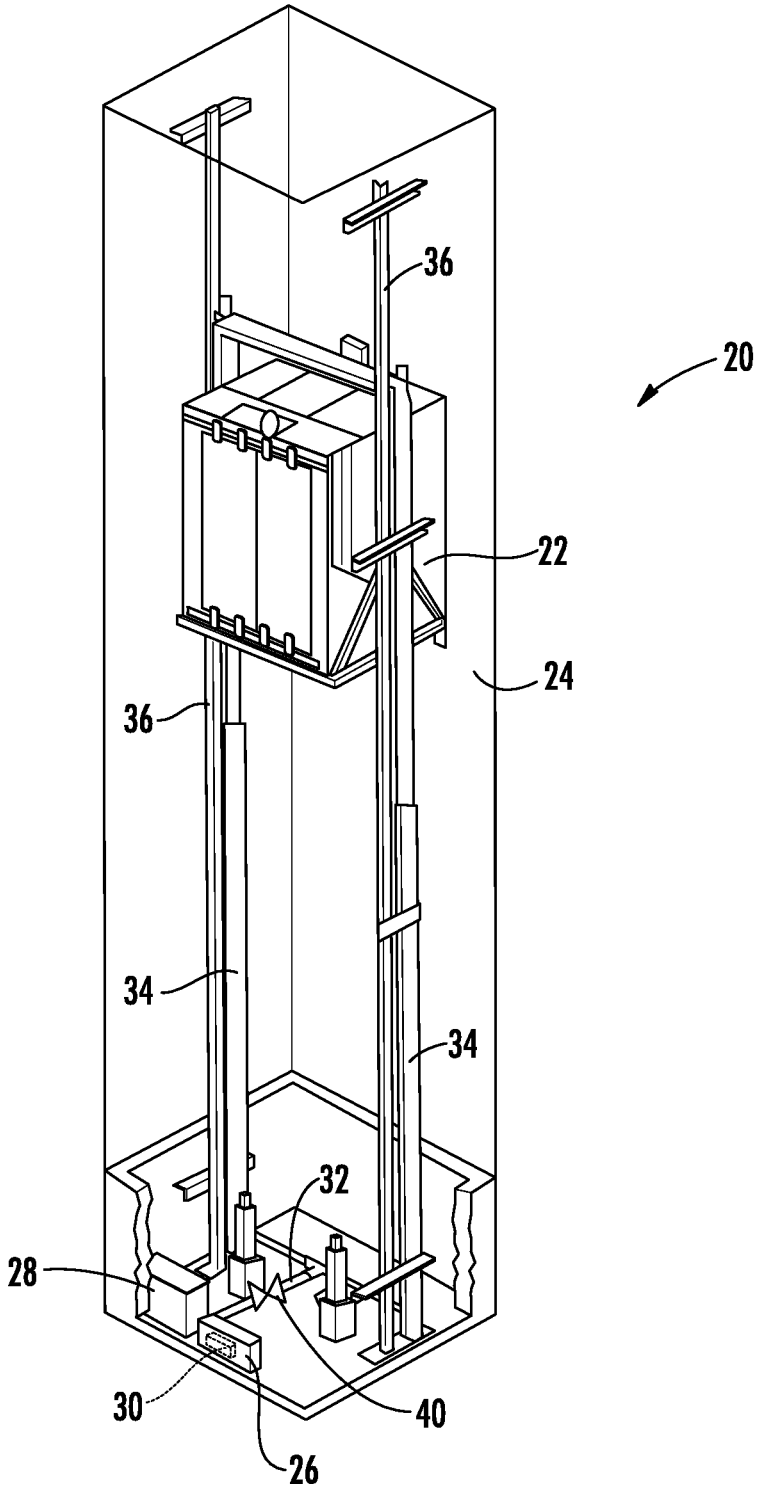
FIG. 1 diagrammatically illustrates selected portions of a hydraulic elevator system designed according to an embodiment of this invention.

FIG. 1 diagrammatically illustrates selected components of an elevator system 20. An elevator car 22 is situated for vertical movement within a hoistway 24. The elevator system 20 is a hydraulic elevator system that utilizes fluid from a reservoir 26 to cause selective movement of the elevator car 22. A control 28 controls operation of a pump 30 to distribute fluid from the reservoir 26 through a conduit network 32 to a hydraulic plunger 34. The illustrated example includes two hydraulic plungers 34 but other embodiments will have only one plunger. An increased amount of fluid in the plungers 34 causes them to extend, which raises the elevator car 22 along guiderails 36 within the hoistway 24. As fluid returns from the plungers 34 to the reservoir 26, the elevator car 22 descends within the hoistway 24.

Under certain circumstances, it is desirable for a mechanic or technician to perform maintenance on the elevator system 20. A valve assembly 40 is provided on a selected conduit of the conduit network 32 between the pump 30 and the hydraulic plungers 34. When the valve assembly 40 is open, fluid is allowed to flow between the reservoir 26 and the hydraulic plungers 34 so that the elevator car 22 can move. When the valve assembly 40 is closed, however, the hydraulic fluid cannot flow through the valve assembly 40 and the elevator car 22 is prevented from moving from a current position in the hoistway 24.

Figure 2:
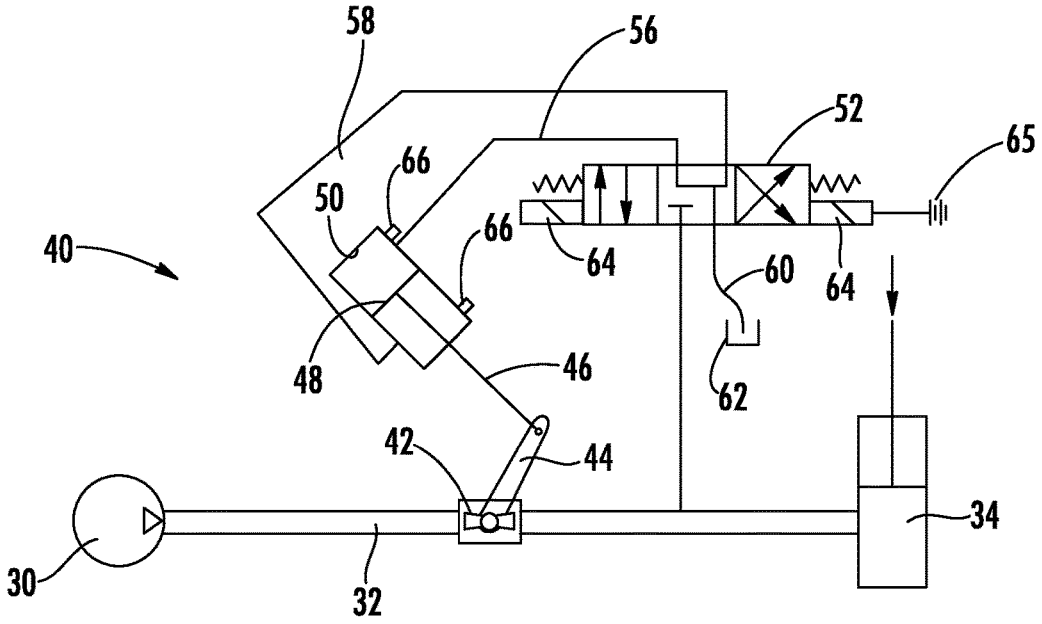
FIG. 2 schematically illustrates a valve assembly designed according to an embodiment of this invention.

FIG. 2 schematically illustrates an example embodiment of the valve assembly 40. This example includes a shutoff valve 42 on one of the conduits of the network 32. The shutoff valve 42 in this example comprises a ball valve. A handle 44 is at least partially exterior to the shutoff valve 42 and could be manually manipulated to open or close the shutoff valve 42. The handle 44 provides a visible indication of a position or condition of the shutoff valve 42, such as whether the valve is fully opened or closed.

A ram 46 of a valve actuator is connected to the handle 44 so that movement of the ram 46 causes movement of the handle 44 to selectively open or close the shutoff valve 42. In this example, a piston 48 is supported on the ram 46. The piston 48 is received within and moveable within a chamber 50. At least one control valve 52 selectively allows fluid pressure from the elevator system to cause movement of the piston 48 and ram 46 to close or open the shutoff valve 42. In some embodiments the valve handle 44 is manually moveable even with the ram 46 connected to the handle 44.

The control valve 52 selectively directs hydraulic fluid from the elevator system toward a first side of the piston 48 through a conduit 56. As the amount of fluid increases on the first side of the piston 48, an amount of fluid in the chamber 50 on a second, opposite side of the piston 48 flows through another conduit 58 into the reservoir 26. In this example, the control valve 52 includes a fluid outlet 60 and check valve 62 to control fluid flow to the reservoir 26 without allowing fluid from the reservoir 26 to enter the shutoff valve assembly 40.

The hydraulic fluid of the elevator system is pressurized by the force associated with the weight of the elevator car 22 resting on the hydraulic plungers 34. That pressure is useful for moving the shutoff valve 42 between an open and closed position as needed.

The control valve 52 includes low voltage, low power solenoids 64 to control the condition or position of the control valve 52. Low voltage, low power solenoids 64 allow for using a simple battery power source 65 for operating the valve assembly 40 for situations, for example, when a main power source is unavailable. The solenoids 64 receive power through building power in some embodiments.

When it is desirable to close the shutoff valve 42, an individual can cause the control valve 52 to allow fluid flow through the conduit 56 toward the first side of the piston 48. An increase in fluid on the first side of the piston 48 causes the piston and ram to move in a manner that moves the handle 44 and closes the valve 42. Once the valve 42 is closed, the control valve 52 is moved into a position that maintains the piston 48, ram 46 and handle 44 in the position corresponding to a closed condition of the shutoff valve 42 by not allowing fluid to enter or exit the chamber 50.

In some embodiments, the handle 44 is situated relative to the hoistway or elevator system 20 so that the position of the handle 44 is visible for a visual confirmation of the position of the shutoff valve 42. The example of FIG. 2 includes at least one detector 66 that detects the position of the piston 48 within the chamber 50. The detector 66 provides an indication of the position of the piston 48 and ram 46, which provides information regarding the position of the handle 44 and the condition of the valve 42. In the example of FIG. 2, two detectors 66 are provided for detecting when the valve 42 is in a fully open and fully closed position, respectively. In one example, the detectors 66 comprise reed switches. Other electronic position indicators are used in some embodiments.

When it is desired to open the shutoff valve 42, an individual can cause the control valve 52 to move into another position that allows fluid flow, resulting from the pressure in the plungers 34, through the conduit 58 toward the second side of the piston 48 causing movement of the piston 48 within the chamber 50 and corresponding movement of the ram 46. The handle 44 moves responsive to movement of the ram 46 until the shutoff valve 42 is in a fully opened position or the control valve 52 interrupts the flow of additional fluid toward the second side of the piston 48. In the illustrated example, once the piston 48 reaches a position corresponding to the shutoff valve 42 being fully opened, the detector 66 provides an indication of that position confirming that the valve has been opened. To keep the shutoff valve open, the control valve 52 changes to a condition that does not allow fluid flow into or out of the chamber 50.

The control valve 52 may be manually controlled by an individual using a hard-wired switch or remote control, for example.

The example valve assembly 40 includes a manually controllable shutoff valve 42 that complies with current elevator codes and utilizes pressure within the hydraulic elevator system for actuating the shutoff valve 42 without requiring an individual to be able to manually manipulate the handle 44.

Figure 3:
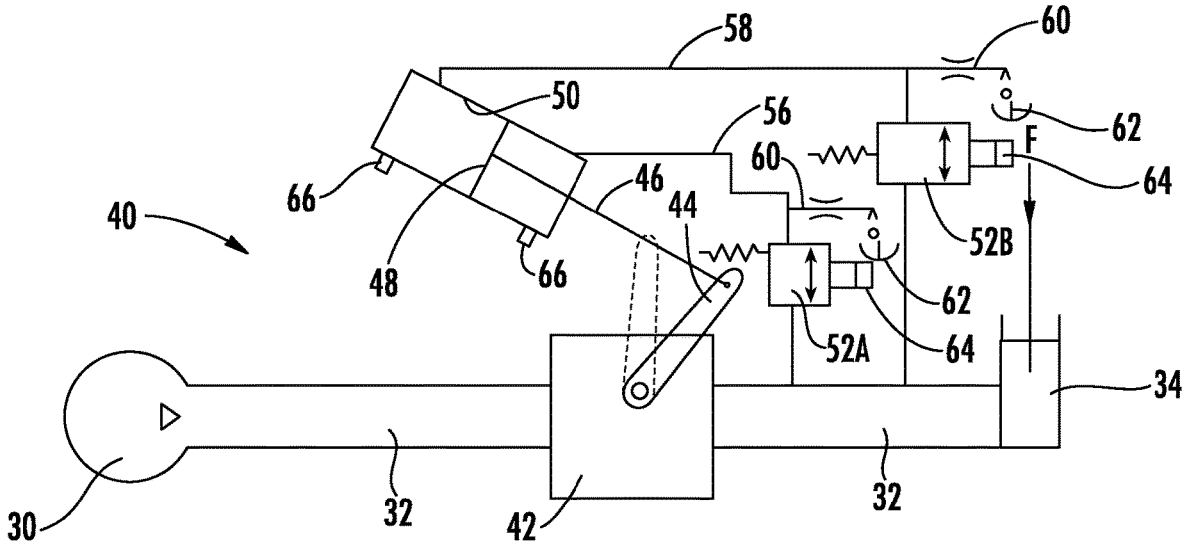
FIG. 3 schematically illustrates another embodiment of a valve assembly.

FIG. 3 illustrates another example embodiment including a plurality of control valves 52A and 52B instead of a single control valve 52 as shown in the example of FIG. 2. Multiple poppet valves are used in some embodiments. The valve assembly of FIG. 3 operates in the same manner as the valve assembly in FIG. 2.

The disclosed embodiments are useful in a variety of situations including hydraulic elevator systems that do not have an access door to the location of the valve or in circumstances in which the valve may not be directly accessible. When there is no access door or the valve is not directly accessible, an individual cannot manually adjust a position or condition of the valve. The disclosed embodiments solve the problem of providing valve control for such situations.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A hydraulic elevator system, comprising:

an elevator car;

a hydraulic plunger associated with the elevator car;

a fluid reservoir;

a conduit coupling the fluid reservoir and the hydraulic plunger;

a pump that causes fluid movement through the conduit between the fluid reservoir and the hydraulic plunger to cause selective movement of the elevator car;

a shutoff valve associated with the conduit, the shutoff valve being between the pump and the hydraulic plunger, the shutoff valve having a closed position in which the shutoff valve prevents fluid movement to or from the hydraulic plunger to prevent movement of the elevator car, the shutoff valve having an open position in which the shutoff valve permits fluid movement between the hydraulic plunger and at least one of the pump and the reservoir to permit movement of the elevator car, the shutoff valve including a handle that is moveable to place the shutoff valve into the open position or the closed position; and a valve actuator that operates based on pressure in the hydraulic plunger for selectively causing the shutoff valve to be in the open position, the valve actuator also operating based on the pressure in the hydraulic plunger for selectively causing the shutoff valve to be in the closed position, the valve actuator comprising a ram coupled with the handle, wherein the pressure causes movement of the ram to cause movement of the handle.

2. The hydraulic elevator system of claim 1, wherein the ram includes a piston;

the valve actuator includes at least one control valve that controls fluid movement toward opposite sides of the piston;

the control valve directing fluid toward a first side of the piston to cause movement of the ram for moving the shutoff valve into the closed position; and the control valve directing fluid toward a second side of the piston to cause movement of the ram for moving the shutoff valve into the open position.

3. The hydraulic elevator system of claim 2, comprising a fluid outlet associated with the at least one control valve, the fluid outlet being configured to direct fluid from one side of the piston to the reservoir; and a check valve that permits fluid flow through the fluid outlet in one direction toward the reservoir and prevents fluid flow in an opposite direction through the fluid outlet.

4. The hydraulic elevator system of claim 2, wherein the control valve includes a solenoid that controls whether the control valve directs fluid toward one of the sides of the piston; and the solenoid is powered by a battery.

5. The hydraulic elevator system of claim 2, wherein the control valve has a first position for directing fluid toward the first side of the piston;

the control valve has a second position for directing fluid toward the second side of the piston; and the control valve has a third position for maintaining a current amount of fluid on each side of the piston when the shutoff valve is in a desired one of the positions.

6. The hydraulic elevator system of claim 1, comprising at least one sensor that provides an indication of a position of the ram as an indication of whether the shutoff valve is in the closed position.

7. The hydraulic elevator system of claim 1, wherein the shutoff valve comprises a manually operable ball valve.

8. The hydraulic elevator system of claim 1, wherein the pressure in the hydraulic plunger is caused by a weight of the elevator car.

9. A hydraulic elevator system, comprising:

an elevator car;

a hydraulic plunger associated with the elevator car;

a fluid reservoir;

a conduit coupling the fluid reservoir and the hydraulic plunger;

a pump that causes fluid movement through the conduit between the fluid reservoir and the hydraulic plunger to cause selective movement of the elevator car;

a shutoff valve associated with the conduit, the shutoff valve being between the pump and the hydraulic plunger, the shutoff valve having a closed position in which the shutoff valve prevents fluid movement to or from the hydraulic plunger to prevent movement of the elevator car, the shutoff valve having an open position in which the shutoff valve permits fluid movement between the hydraulic plunger and at least one of the pump and the reservoir to permit movement of the elevator car; and a valve actuator that operates based on pressure in the hydraulic plunger for selectively causing the shutoff valve to be in the open position, the valve actuator also operating based on the pressure in the hydraulic plunger for selectively causing the shutoff valve to be in the closed position, wherein the shutoff valve has a handle for manually moving the shutoff valve between the open and closed positions;

the handle is at least partially visible from outside the shutoff valve;

the valve actuator is coupled to the handle for moving the handle; and the valve actuator is coupled to the handle in a manner that allows for visual observation of a position of the handle indicative of a position of the shutoff valve.

10. An assembly for controlling whether an elevator car can move in a hydraulic elevator system in response to a change in hydraulic fluid in a hydraulic plunger associated with the elevator car, the assembly comprising:

a shutoff valve configured to selectively allow or prevent a flow of elevator system hydraulic fluid through the shutoff valve to thereby selectively allow or prevent movement of the elevator car, respectively; and a valve actuator including a ram coupled to the shutoff valve in a manner that movement of the ram opens or closes the shutoff valve, and at least one control valve associated with the ram to selectively allow pressure of the hydraulic fluid in the hydraulic plunger to cause movement of the ram for selectively opening the shutoff valve and selectively closing the shutoff valve, wherein the shutoff valve has an external handle adapted for manual manipulation to open or close the shutoff valve; and the ram is coupled to the handle in a manner that the movement of the ram causes movement of the handle.

11. The assembly of claim 10, wherein the valve actuator includes a chamber and a piston situated for movement in the chamber;

the piston is connected to the ram for movement with the ram;

the control valve selectively controls pressure on opposite sides of the piston to control a position of the ram and whether the shutoff valve is open or closed.

12. The assembly of claim 11, comprising at least one detector that provides an indication of a position of the piston within the chamber and wherein the indication provides information regarding whether the shutoff valve is open or closed.

13. The assembly of claim 11, comprising a fluid outlet associated with the at least one control valve, the fluid outlet being configured to direct fluid away from the chamber; and a check valve that permits fluid flow through the fluid outlet only away from the chamber and prevents fluid flow in an opposite direction through the fluid outlet.

14. The assembly of claim 11, wherein the control valve has a first position for directing fluid toward a first side of the piston;

the control valve has a second position for directing fluid toward a second side of the piston; and the control valve has a third position for maintaining a current amount of fluid on each side of the piston when the shutoff valve is in a desired one of the positions.

15. The assembly of claim 10, wherein the ram is coupled to the shutoff valve in a manner that allows visual observation of an external component of the shutoff valve which provides a visual indication of whether the shutoff valve is open or closed.

16. The assembly of claim 10, wherein the control valve includes a solenoid that is powered by a battery.

17. An assembly for controlling whether an elevator car can move in a hydraulic elevator system in response to a change in hydraulic fluid in a hydraulic plunger associated with the elevator car, the assembly comprising:

a shutoff valve configured to selectively allow or prevent a flow of elevator system hydraulic fluid through the shutoff valve to thereby selectively allow or prevent movement of the elevator car, respectively; and a valve actuator including a ram coupled to the shutoff valve in a manner that movement of the ram opens or closes the shutoff valve, and at least one control valve associated with the ram to selectively allow pressure of the hydraulic fluid in the hydraulic plunger to cause movement of the ram for selectively opening the shutoff valve and selectively closing the shutoff valve, wherein the valve actuator includes a chamber and a piston situated for movement in the chamber;

the piston is connected to the ram for movement with the ram, the control valve selectively controls pressure on opposite sides of the piston to control a position of the ram and whether the shutoff valve is open or closed.

* * * * *